United States Patent [19]

Klingaman

[11] 4,151,911

[45] May 1, 1979

[54] PACKAGE

[75] Inventor: Richard J. Klingaman, Darien, Conn.

[73] Assignee: Colgate-Palmolive Company, New York, N.Y.

[21] Appl. No.: 873,072

[22] Filed: Jan. 27, 1978

Related U.S. Application Data

[63] Continuation of Ser. No. 735,661, Oct. 26, 1976, abandoned.

[51] Int. Cl.[2] ..... B65D 75/00

[52] U.S. Cl. ..... 206/229; 206/562

[58] Field of Search ..... 206/486, 487, 490, 45.14, 206/168, 229, 562, 563, 564, 216; 220/23.8

[56] References Cited

U.S. PATENT DOCUMENTS

| | | | |
|---|---|---|---|
| D. 223,681 | 5/1972 | Whitaker | 206/563 X |
| 2,985,289 | 5/1961 | U'Ren | 206/229 |
| 2,986,438 | 5/1961 | Smathers et al. | 206/564 X |
| 3,111,253 | 11/1963 | Hennessey | 206/229 X |
| 3,467,243 | 9/1969 | Butcher | 206/216 X |
| 3,745,973 | 7/1973 | Knecht | 220/23.8 X |
| 3,809,226 | 5/1974 | Ferrari | 206/229 |

FOREIGN PATENT DOCUMENTS

| | | | |
|---|---|---|---|
| 851697 | 10/1952 | Fed. Rep. of Germany | 206/216 |

*Primary Examiner*—William Price
*Assistant Examiner*—Joseph M. Moy
*Attorney, Agent, or Firm*—Strauch, Nolan, Neale, Nies & Kurz

[57] ABSTRACT

A retainer and display package mounting a container-dispenser that projects upwardly through a retaining opening in a top wall alongside a transparent cap enclosing a capsule seated on the top wall. The capsule is intended for incorporation in the container-dispenser in use, and the bottom wall must be removed and the cap detached to extract the container-dispenser and capsule for use.

5 Claims, 4 Drawing Figures

PACKAGE

This is a continuation of application Ser. No. 735,661, filed Oct. 26, 1976, now abandoned.

This invention relates to special packaging and particularly to the packaging of items that are to be maintained separately until the time of use by the consumer.

In its preferred embodiment the invention will be described as incorporated in a package assembly wherein a container-dispenser as one item, is packaged with a capsule that, as another item, is to be eventually incorporated into the container-dispenser by the consumer.

The package itself comprises a hollow body having an openable bottom wall upon which the container-dispenser seats and projects up through a retaining opening in an otherwise closed top body wall. The top wall is formed with an upwardly open well to mount an upstanding capsule, and a retainer cover is secured over the capsule. The packaged items are thus retained separately in the package until use by the consumer, who destroys and discards the package at that time.

It is therefore an important aspect of the invention to provide a novel package assembly wherein a container-dispenser unit is separately maintained in display association with a capsule of concentrate or like substance to be introduced into the dispenser-container unit by the ultimate consumer.

Important detail features of the invention provide a special stable package body structure formed to retain and display a container-dispenser item and a capsule item intended for assembly therewith while requiring that the structure be destroyed in order to combine the items for use.

Further features of the invention will appear as the description proceeds in connection with the appended claims and the drawings.

PREFERRED EMBODIMENTS

Figure 1:
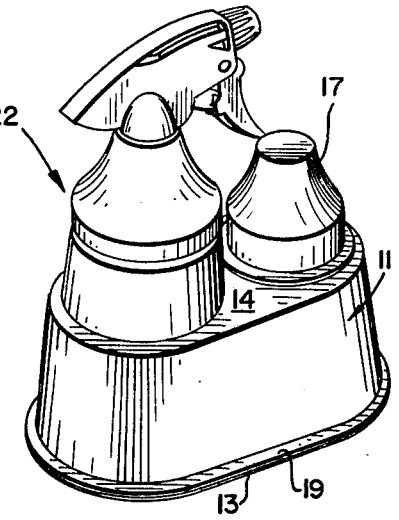
FIG. 1 is a generally perspective view showing the package of the invention according to a preferred embodiment.
Figure 2:
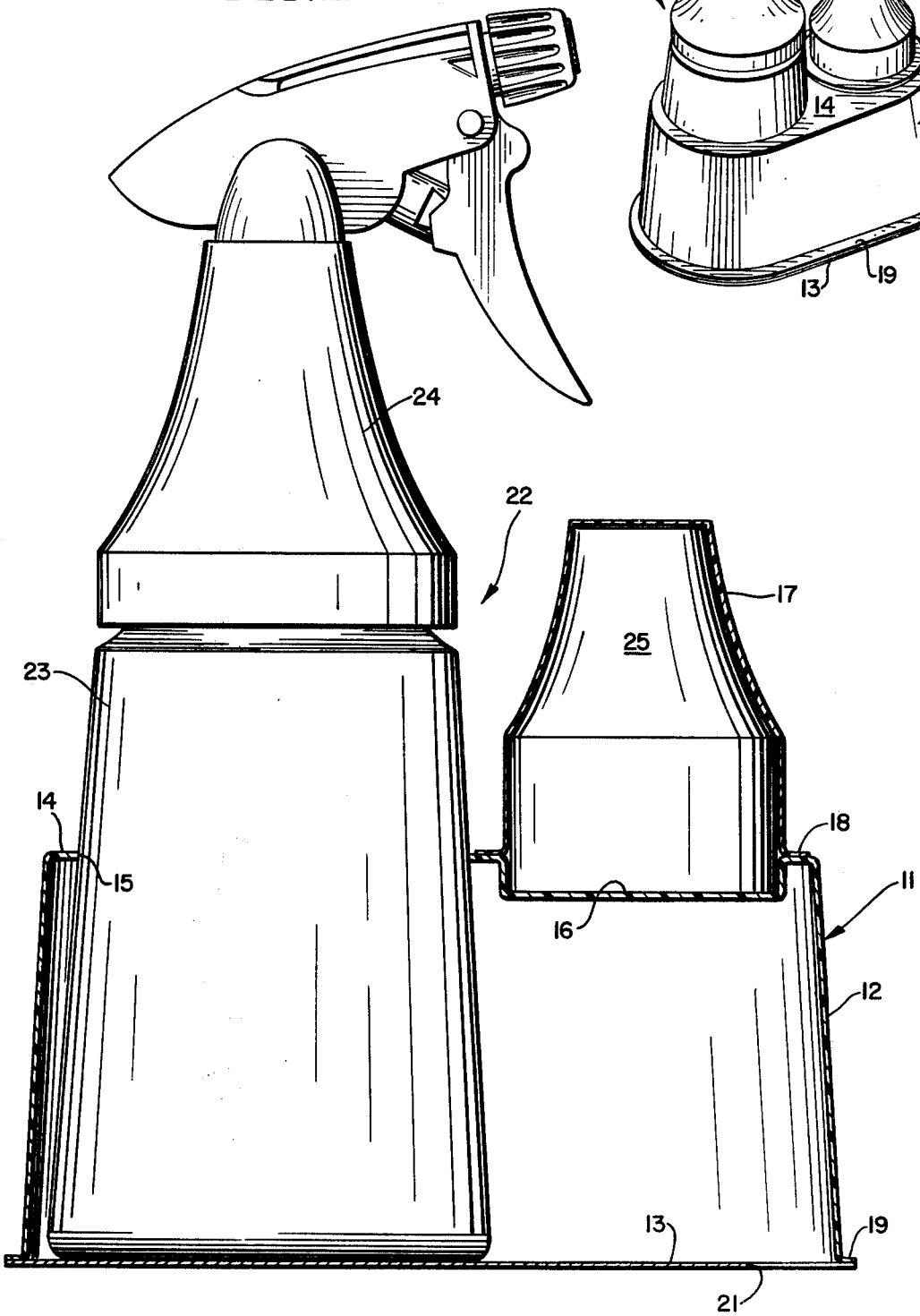
FIG. 2 is a side elevation mainly in section showing the package components.
Figure 3:
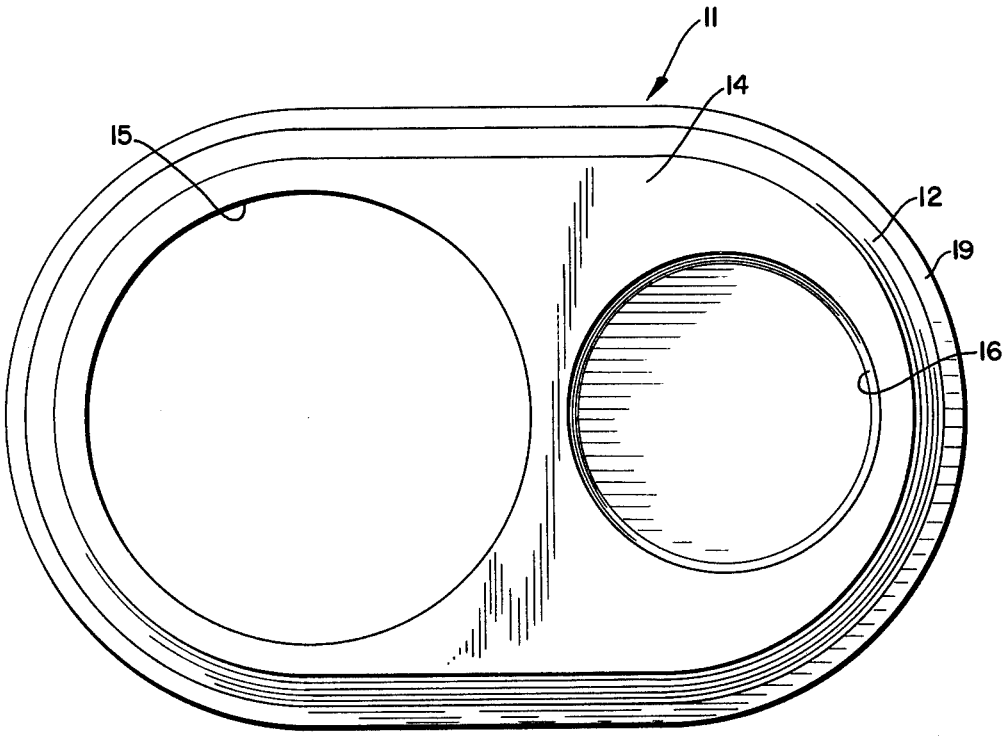
FIG. 3 is a top plan view of the package body, with the packaged items removed.
Figure 4:
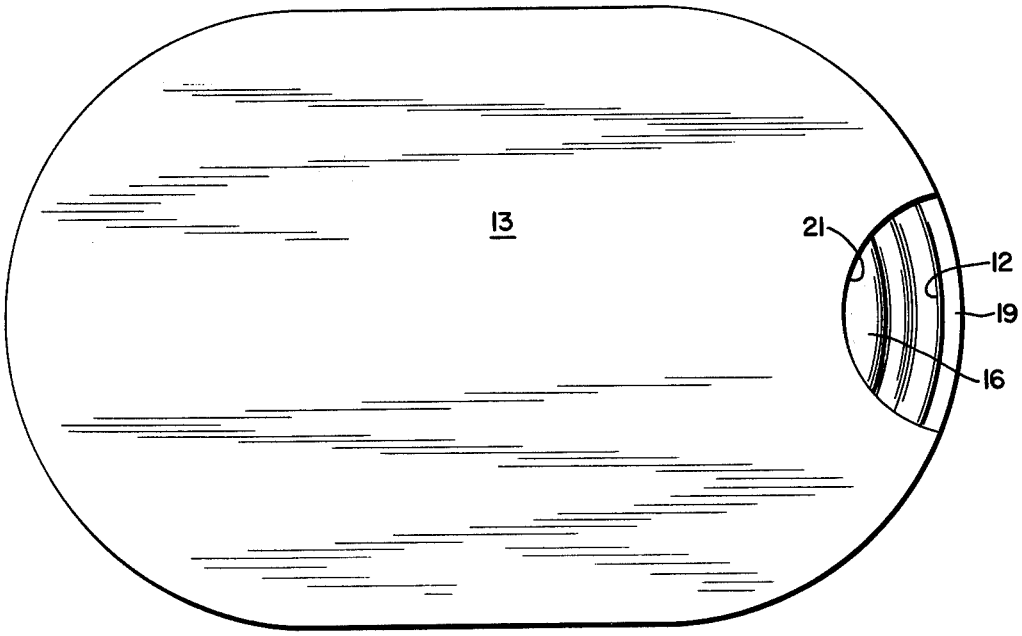
FIG. 4 is a bottom plan view of the package.

The package of the invention comprises a hollow body 11 having a relatively stiff side wall 12, a removable bottom wall 13, and a top wall 14 containing a circular opening 15 and a shallow upwardly open well 16 in side by side relation. The top wall is thus closed except for opening 15. A stiff walled hollow cap 17 has a rim 18 around its open end secured adhesively to wall 14 around the upper edge of well 16. The lower edge of side wall 12 is formed with an external flange 19, and bottom wall 13 is adhesively secured to flange 19. For ease in removing the bottom wall a finger receiving notch 21 (FIG. 4) is provided therein.

The packaged items are a container and pump assembly 22 consisting of a tapered wall container 23 and a removable cover 24 incorporating the pump unit, and a capsule 25 of concentrate or the like adapted to be incorporated into the assembly 22 at the time of use. In the assembly the tapered wall container 23 is seated on the flat inner surface of bottom wall 13 and projects upwardly through opening 15 which is of such diameter as to relatively snugly surround the container at the point the container passes through the top wall. Since the larger tapered end of the container assembly is within the package body, the foregoing structure effectively prevents accidental or any other removal of the assembly 22 from the package through opening 15.

The capsule 25 is seated at its lower end in well 16, and it is maintained in the package by cap 17, the lower annular rim 18 of which is adhesively secured to the top surface of wall 14 around the edge of well 16. Preferably cap 17 is an integral element of stiff shape retaining transparent plastic.

The body 11 is preferably an integral preformed open bottom element of light weight plastic, and bottom wall 13 is a separate sheet of the same material. The walls of body 11, including bottom wall 13, are stiff and shape retaining. The package is of such dimensions and balance that it will stand upright on bottom wall 13 without tipping.

In practice the assembly is sold to a customer in the form shown in the drawings, with the container empty and the filled capsule visible through retainer cap 17. When the customer wishes to put the assembly in condition for use, he inserts a finger in notch 21 and strips bottom wall off the body 11. This enables the extraction of the container and pump assembly through the now open bottom of the package. Then the cap 17 is pulled off the top wall to enable removal of the capsule 25. The package body and wall 13 are discarded. The user then removes the screw threaded cap 24 from the container and pump assembly 22, fills the container to a desired level with the liquid to be mixed with the concentrate, inserts capsule 25 into the container mouth and reassembles by screwing the cap and pump assembly back onto the container, this operation automatically opening the capsule to discharge its contents into the container.

The particular structures of the container and pump assembly 22 and the capsule 25 are not part of the present invention and they are preferably those disclosed in the copending application of Richard J. Klingaman, Ser. No. 665,758 filed Mar. 11, 1976 for Capsule and Container Therefor, now U.S. Pat. No. 4,088,246, issued May 8, 1978.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A package comprising a hollow body having a continuous stiff side wall, a bottom wall extending across and removably attached around its periphery to the lower edges of said side wall and a fixed top wall extending across the upper edges of said side wall and having an opening, a container-dispenser having its lower end seated on said bottom wall within said body and extending upwardly through said top wall opening, said container-dispenser consisting of a tapered wall container and a closure for the container removably mounted on the container above said top wall and carrying dispensing control means, and said opening having a diameter only slightly larger than the diameter of the container at the point the container passes through said opening, whereby said container-dispenser cannot be removed upwardly through said opening, a capsule containing liquid to be dispensed, sized for incorporation within said closure during use of the container-dispenser by the consumer, said capsule being seated on said top wall and projecting upwardly therefrom alongside said container-dispenser, and an inverted cup-shaped retainer cap enclosing said capsule secured to said top wall, and said container-dispenser being removable from the package only when said bottom wall is removed.

2. The package defined in claim 1, wherein the side wall of said body is integral with said top wall which latter is closed except for said opening.

3. The package defined in claim 1, wherein said top wall is formed with an upwardly open well for seating said capsule and said cap is formed with a rim secured upon said top wall around the edge of said well.

4. The package defined in claim 1, wherein said cap is transparent.

5. The package defined in claim 1, wherein said package body is an integral stiff-walled inverted cup-shaped structure and said bottom wall means is a relatively stiff sheet extending across the open end of said body.

* * * * *